US009263789B2

(12) United States Patent
Breiter

(10) Patent No.: US 9,263,789 B2
(45) Date of Patent: Feb. 16, 2016

(54) ANTENNA APPARATUS AND METHODS

(75) Inventor: Richard Breiter, Fredriksberg (DK)

(73) Assignee: Nokia Technologies Oy, Espoo (FI)

( * ) Notice: Subject to any disclaimer, the term of this patent is extended or adjusted under 35 U.S.C. 154(b) by 178 days.

(21) Appl. No.: 13/989,249

(22) PCT Filed: Nov. 25, 2010

(86) PCT No.: PCT/IB2010/055433
§ 371 (c)(1),
(2), (4) Date: May 23, 2013

(87) PCT Pub. No.: WO2012/069884
PCT Pub. Date: May 31, 2012

(65) Prior Publication Data

US 2013/0241781 A1 Sep. 19, 2013

(51) Int. Cl.

| | |
|---|---|
| ***H01Q 1/24*** | (2006.01) |
| ***H01Q 5/35*** | (2015.01) |
| ***H01Q 5/364*** | (2015.01) |
| ***H01Q 5/40*** | (2015.01) |

(52) U.S. Cl.
CPC ..... *H01Q 1/243* (2013.01); *H01Q 5/35* (2015.01); *H01Q 5/364* (2015.01); *H01Q 5/40* (2015.01); *Y10T 29/49016* (2015.01)

(58) Field of Classification Search
CPC ..... H01Q 5/35; H01Q 5/364; H01Q 1/243; H01Q 5/40
USPC ..... 343/702, 700 MS, 872, 873, 741, 866
See application file for complete search history.

(56) References Cited

U.S. PATENT DOCUMENTS

| | | | | |
|---|---|---|---|---|
| 6,686,886 | B2 * | 2/2004 | Flint et al. | 343/702 |
| 8,854,267 | B2 * | 10/2014 | Kim et al. | 343/702 |
| 2003/0137458 | A1 | 7/2003 | Troelsen | |
| 2006/0192714 | A1 | 8/2006 | Koyama et al. | |
| 2009/0160712 | A1 | 6/2009 | Breiter et al. | |
| 2010/0087235 | A1 | 4/2010 | Chiang | |
| 2010/0123633 | A1 | 5/2010 | Ozden et al. | |
| 2011/0001673 | A1 * | 1/2011 | You et al. | 343/702 |

FOREIGN PATENT DOCUMENTS

| | | | |
|---|---|---|---|
| CN | 1457530 | A | 11/2003 |
| EP | 2081257 | A1 | 7/2009 |
| WO | 02/071536 | A1 | 9/2002 |

OTHER PUBLICATIONS

Office action received for corresponding Chinese Patent Application No. 201080071057.0, dated Jul. 1, 2014, 6 pages of Office Action and no English translation available.

(Continued)

*Primary Examiner* — Hoanganh Le
(74) *Attorney, Agent, or Firm* — Nokia Technologies Oy

(57) ABSTRACT

An apparatus comprising: a cover portion defining an exterior surface of the apparatus and including a conductive cover part; a first conductive loop connected to the conductive cover part; and a first coupling member, connectable to radio circuitry and configured to electromagnetically couple with at least one of the first conductive loop and the conductive cover part, wherein at least the conductive cover part and the first conductive loop have a first electrical length and are configured to operate in a first frequency band.

20 Claims, 9 Drawing Sheets

(56) References Cited

OTHER PUBLICATIONS

Extended European Search Report received for corresponding European Patent Application No. 10860037.0, dated Jul. 22, 2014, 8 pages.

International Search Report and Written Opinion received in corresponding Patent Cooperation Treaty Application PCT/IB2010/044533. Dated Jul. 21, 2011. 10 pages.

Office action received for corresponding Chinese Patent Application No. 201080071057.0, dated May 22, 2015, 3 pages of office action and 3 pages of office action translation available.

* cited by examiner

ANTENNA APPARATUS AND METHODS

RELATED APPLICATION

This application was originally filed as PCT Application No. PCT/IB2010/055433 filed Nov. 25, 2010.

TECHNOLOGICAL FIELD

Embodiments of the present invention relate to apparatus and methods. In particular, they relate to apparatus in portable electronic devices.

BACKGROUND

Apparatus, such as portable electronic devices, usually include radio circuitry and one or more antennas for enabling the apparatus to communicate wirelessly with other apparatus. In recent years, there has been a trend in the telecommunications industry to use conductive materials in the cover of the apparatus. However, the conductive materials usually interfere with the one or more antennas and reduce their efficiency and/or performance.

It would therefore be desirable to provide an alternative apparatus.

BRIEF SUMMARY

According to various, but not necessarily all, embodiments of the invention there is provided an apparatus comprising: a cover portion including a conductive cover part; a first conductive loop connected to the conductive cover part; and a first coupling member, connectable to radio circuitry and configured to electromagnetically couple with at least one of the first conductive loop and the conductive cover part, wherein at least the conductive cover part and the first conductive loop have a first electrical length and are configured to operate in a first frequency band.

The conductive cover part may include a continuous conductive loop. The continuous conductive loop may extend around at least one side surface of the apparatus. The continuous conductive loop may extend around a perimeter of the apparatus.

The first conductive loop may be positioned within the cover portion.

The apparatus may further comprise a conductive member electrically connected to the first conductive loop, the conductive member being configured to tune one or more resonant frequency bands of the conductive cover part and the first conductive loop in frequency.

The conductive member may be positioned within the cover portion. The conductive member may be positioned within the first conductive loop.

The apparatus may further comprise a second coupling member, connectable to radio circuitry and configured to electromagnetically couple with at least one of the first conductive loop and the conductive cover part.

According to various, but not necessarily all, embodiments of the invention there is provided a portable electronic device comprising an apparatus as described in any of the preceding paragraphs.

According to various, but not necessarily all, embodiments of the invention there is provided a module comprising an apparatus as described in any of the preceding paragraphs.

According to various, but not necessarily all, embodiments of the invention there is provided a method comprising: providing a cover portion including a conductive cover part; providing a first conductive loop connected to the conductive cover part; and providing a first coupling member, connectable to radio circuitry and configured to electromagnetically couple with at least one of the first conductive loop and the conductive cover part, wherein at least the conductive cover part and the first conductive loop have a first electrical length and are configured to operate in a first frequency band.

The conductive cover part may include a continuous conductive loop. The continuous conductive loop may extend around at least one side surface of the apparatus. The continuous conductive loop may extend around a perimeter of the apparatus.

The first conductive loop may be positioned within the cover portion.

The method may further comprise providing a conductive member electrically connected to the first conductive loop, the conductive member being configured to tune one or more resonant frequency bands of the conductive cover part and the first conductive loop in frequency.

The conductive member may be positioned within the cover portion. The conductive member may be positioned within the first conductive loop.

The method may further comprise providing a second coupling member, connectable to radio circuitry and configured to electromagnetically couple with at least one of the first conductive loop and the conductive cover part.

BRIEF DESCRIPTION

For a better understanding of various examples of embodiments of the present invention reference will now be made by way of example only to the accompanying drawings in which.

DETAILED DESCRIPTION

In the following description, the wording 'connect' and 'couple' and their derivatives mean operationally connected or coupled. It should be appreciated that any number or combination of intervening components can exist (including no intervening components). Additionally, it should be appreciated that the connection or coupling may be a physical galvanic connection and/or an electromagnetic connection.

Figure 2:
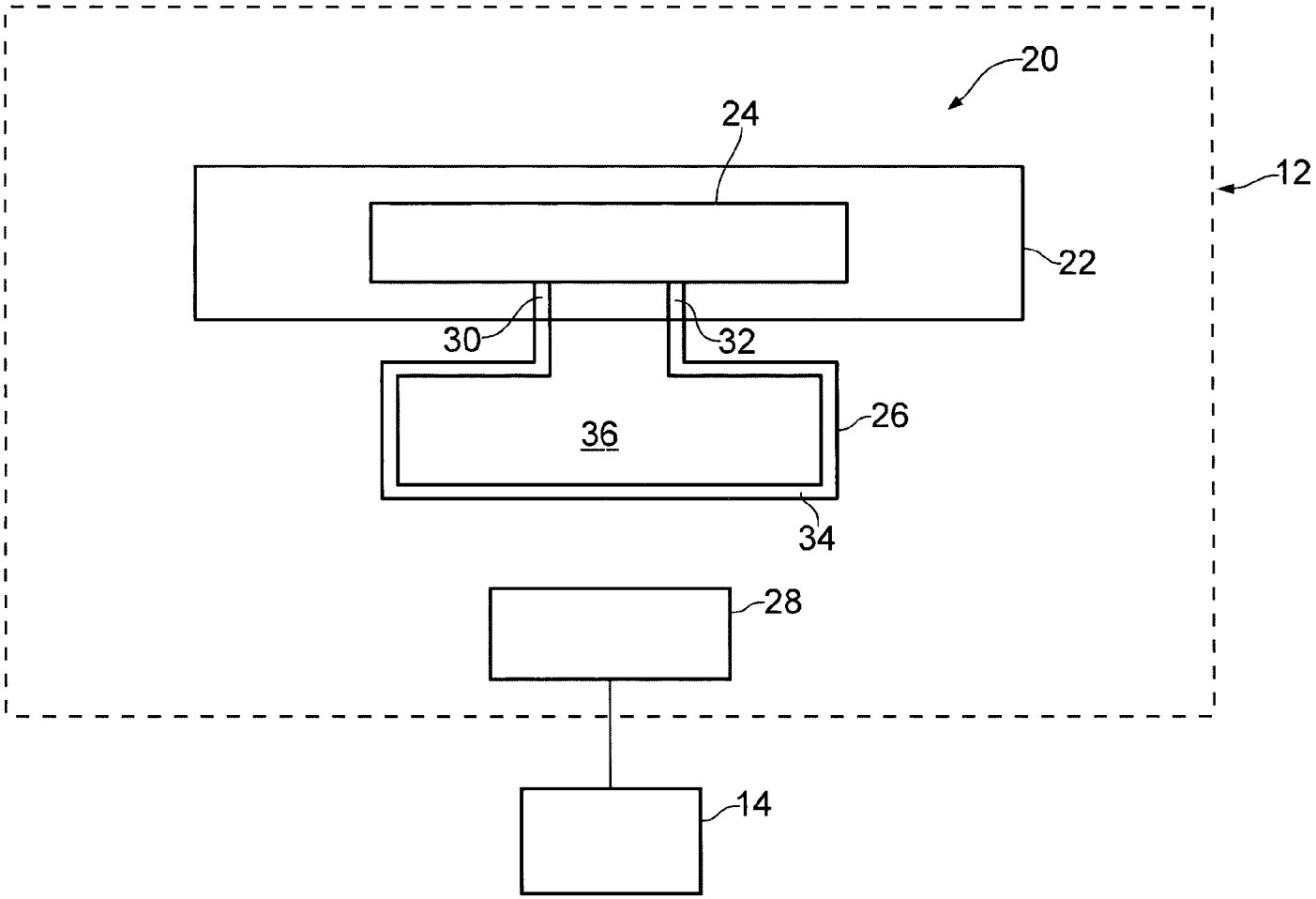
FIG. 2 illustrates a schematic plan view diagram of an apparatus according to various embodiments of the invention.
Figure 3:
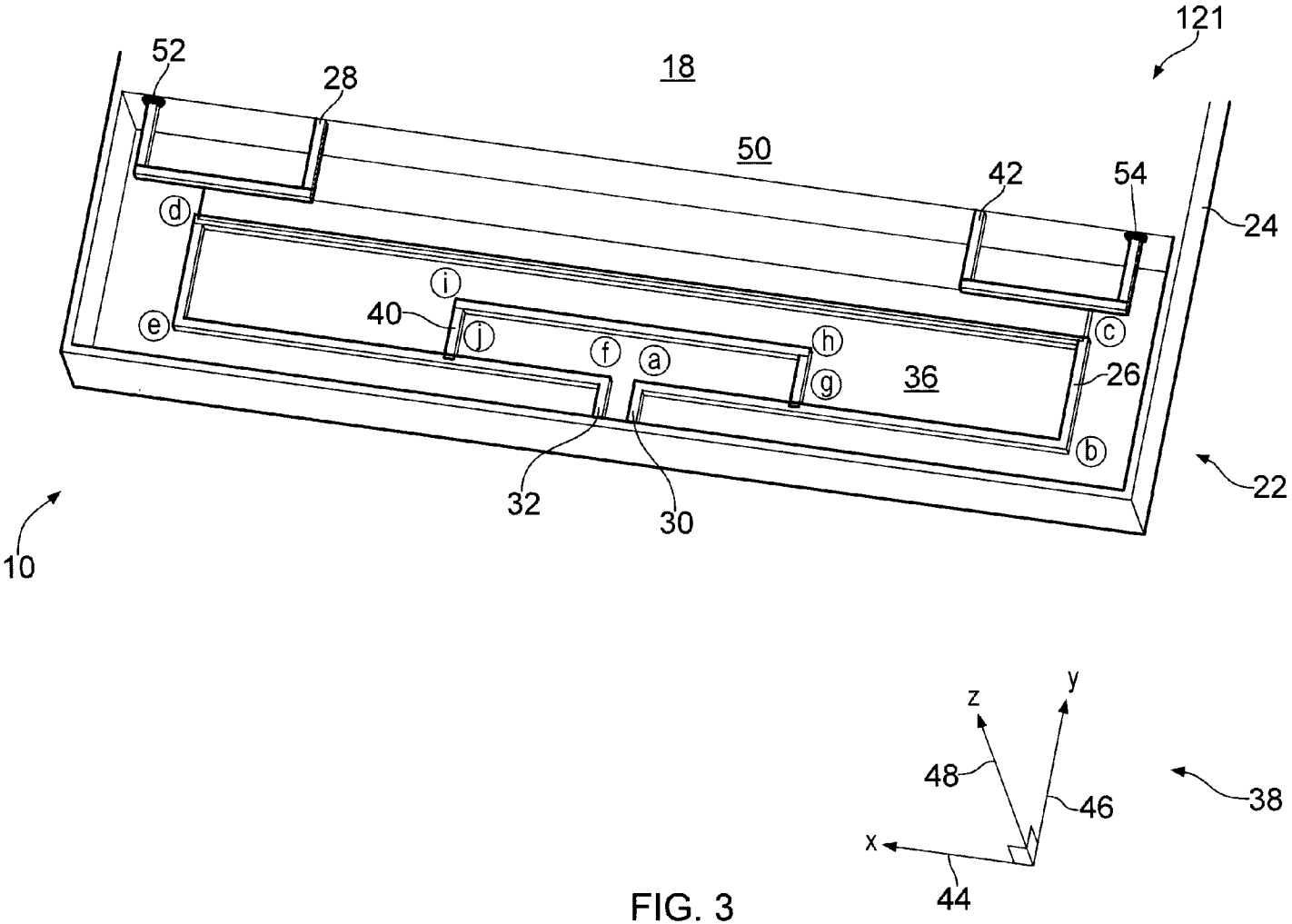
FIG. 3 illustrates a perspective view of another apparatus according to various embodiments of the invention.
Figure 4:
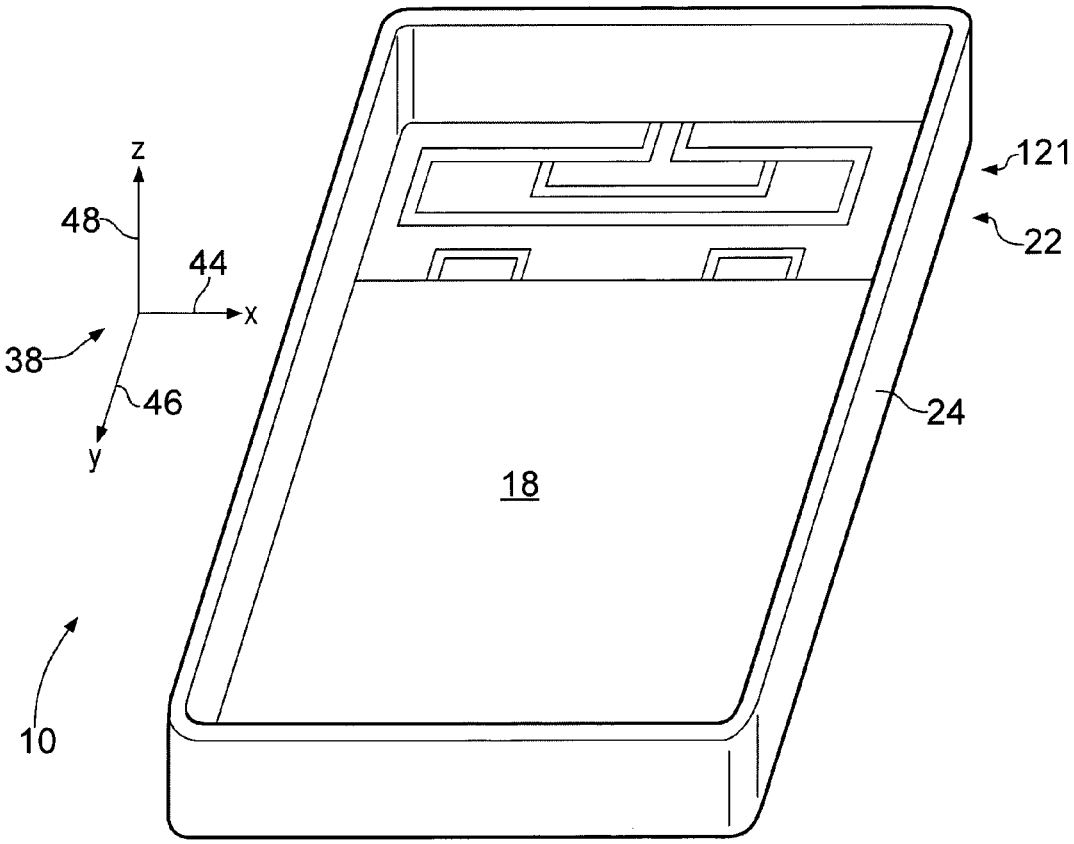
FIG. 4 illustrates another perspective view of the apparatus illustrated in FIG. 3.

FIGS. 2, 3 and 4 illustrate an apparatus 12, 121 comprising: a cover portion 22 including a conductive cover part 24; a first conductive loop 26 connected to the conductive cover part 24; and a first coupling member 28, connectable to radio circuitry 14 and configured to electromagnetically couple with at least the first conductive loop 26 and/or the conductive cover part 24, wherein at least the conductive cover part 24 and the first conductive loop 26 have a first electrical length and are configured to operate in a first frequency band.

Figure 1:
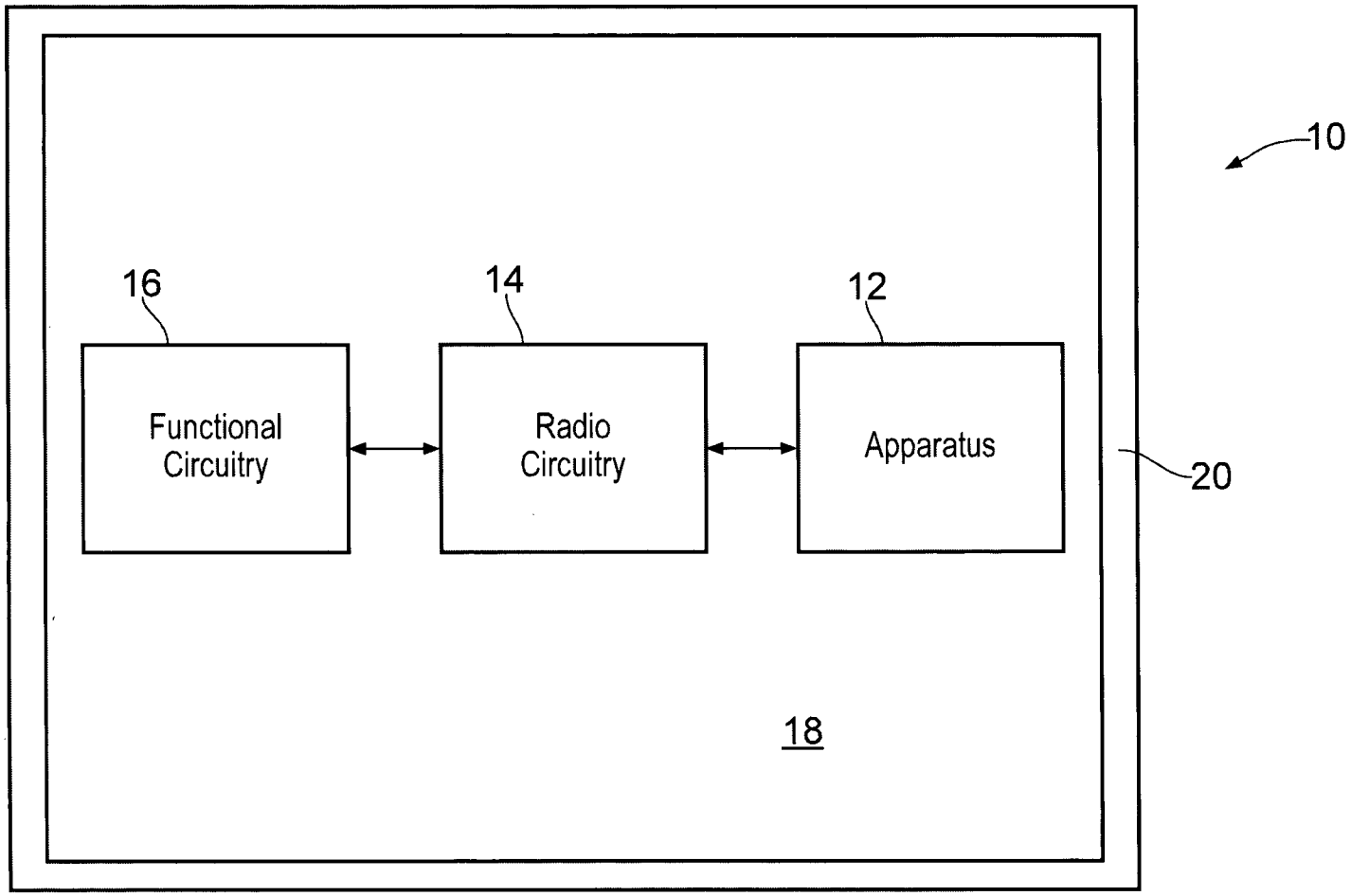
FIG. 1 illustrates a schematic diagram of a portable electronic device according to various embodiments of the invention.

In more detail, FIG. 1 illustrates an electronic device 10 according to various embodiments of the invention. The electronic device 10 may be any apparatus and may be a portable electronic device (for example, a mobile cellular telephone, a tablet computer, a laptop computer, a personal digital assistant or a hand held computer), or a non-portable electronic device (for example, a personal computer or a base station for a cellular network) or a module for such devices. As used here, 'module' refers to a unit or apparatus that excludes certain parts or components that would be added by an end manufacturer or a user.

The electronic device 10 comprises an apparatus 12, radio circuitry 14, functional circuitry 16, a ground member 18 and a cover 20. The apparatus 12 may also be referred to as an antenna arrangement and is configured to transmit and receive, transmit only or receive only electromagnetic signals. The radio circuitry 14 is connected between the apparatus 12 and the functional circuitry 16 and may include a receiver and/or a transmitter. The functional circuitry 16 is operable to provide signals to, and/or receive signals from the radio circuitry 14. The electronic device 10 may include one or more matching circuits between the apparatus 12 and the radio circuitry 14.

In the embodiment where the electronic device 10 is a portable electronic device, the functional circuitry 16 may include a processor, a memory and input/output devices such as an audio input device (a microphone for example), an audio output device (a loudspeaker for example), a user input device (a touch screen display, a keypad or a keyboard for example) and a display.

The apparatus 12 and the electronic components that provide the radio circuitry 14 and the functional circuitry 16 may be interconnected via the ground member 18 (for example, a printed wiring board). The ground member 18 may be used as a ground plane for the apparatus 12 by using one or more layers of the printed wiring board 18. In other embodiments, some other conductive part of the electronic device 10 (a battery cover for example) may be used as the ground member 18 for the apparatus 12. The ground member 18 may be formed from several conductive parts of the electronic device 10, for example and not limited to the printed wiring board, a conductive battery cover, and/or at least a portion of the cover 20 of the electronic device 10. Consequently, it should be appreciated that the ground member 18 may be planar or non-planar.

The cover 20 is configured to house at least some of the components (the functional circuitry 16 for example) of the electronic device 10 and defines the exterior surfaces of the electronic device 10. Consequently, the components of the electronic device 20 may not be visible to a user of the electronic device 10. The cover 20 may also be configured to prevent the ingress of liquids (water for example) to the electronic device 10.

The apparatus 12 and the radio circuitry 14 may be configured to operate in one or more operational frequency bands and via one or more protocols. For example, the operational frequency bands and protocols may include (but are not limited to) Long Term Evolution (LTE) 700 (US) (698.0-716.0 MHz, 728.0-746.0 MHz), LTE 1500 (Japan) (1427.9-1452.9 MHz, 1475.9-1500.9 MHz), LTE 2600 (Europe) (2500-2570 MHz, 2620-2690 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hyper local area network (HLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

A frequency band over which the apparatus 12 can efficiently operate using a protocol is a frequency range where the return loss of the apparatus 12 is greater than an operational threshold. For example, efficient operation may occur when the antenna's return loss is better than −6 dB or −10 dB.

FIG. 2 illustrates a schematic diagram of an apparatus 12 according to various embodiments of the invention. The apparatus 12 includes a cover portion 22 comprising a conductive cover part 24, a conductive loop 26 and a coupling member 28.

The cover portion 22 may define an exterior surface of the apparatus 12 and the electronic device 10 and may consequently be visible to a user of the electronic device 10. In other embodiments, the cover portion 22 may be an internal cover and is covered by an exterior cover. In these embodiments, the cover portion 22 may define an interior surface of the apparatus 12.

The cover portion 22 may be a part of the cover 20 or may be the whole of the cover 20. The cover portion 22 may comprise any suitable material or materials and may, for example, comprise one or more plastics and/or one or more metals. Where the cover portion 22 comprises a conductive material, the conductive cover part 24 may be electrically isolated from the cover portion 22 (that is, there is no galvanic connection between the cover portion 22 and the conductive cover part 24).

Figure 6:
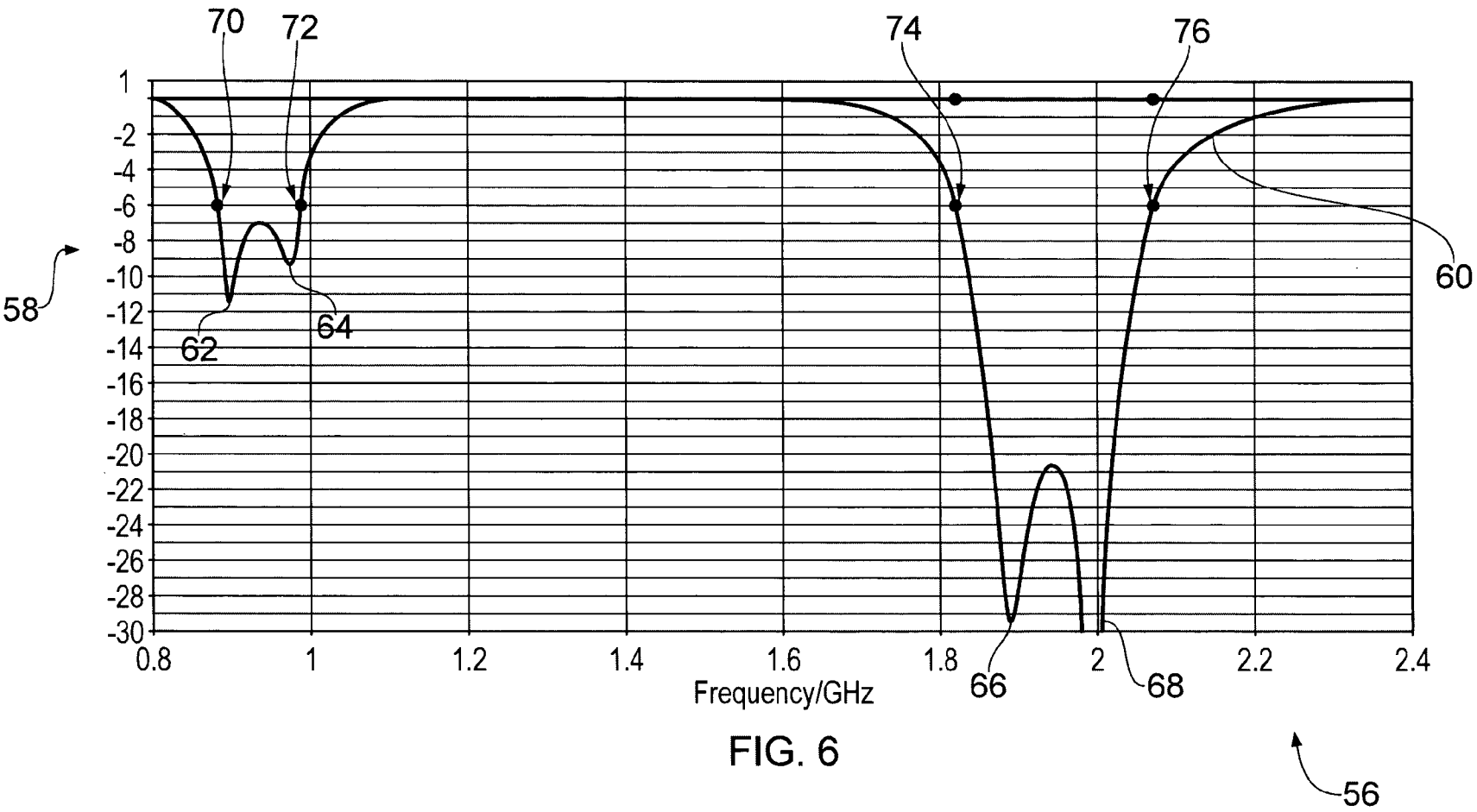
FIG. 6 illustrates a graph of frequency versus return loss for the apparatus illustrated in FIGS. 3 and 4.

The conductive cover part 24 may be a part of the cover portion 22 (for example, the cover portion 22 may include a scratch resistant coating on the conductive cover part 24) or may be the whole of the cover portion 22. The conductive cover part 24 may have any shape and may be, for example, rectangular, square, circular, elliptical or may be a continuous loop (as illustrated in FIGS. 3, 4 and 6 and described in more detail in the following paragraphs). The conductive cover part 24 may comprise any suitable conductive material and may comprise one or more metals.

The conductive loop 26 has a first end 30, a second end 32 and a conductive track 34 that extends between the first end 30 and the second end 32. The conductive loop 26 defines an aperture 36 within the conductive track 34. The conductive loop 26 may have any regular shape and may be, for example, rectangular, square, circular, elliptical, or an irregular shape, and so on. The conductive loop 26 may be substantially planar (2D or two dimensional) or may be disposed in more than one plane (3D or three dimensional).

The conductive loop 26 is electrically connected (that is, galvanically connected) to the conductive cover part 24 at the first and second ends 30, 32. The conductive loop 26 may be integral with the conductive cover part 24 (that is, they may be formed from the same piece of material). In other embodiments, the conductive loop 26 may be separate to the conductive cover part 24 and may be joined together via welding for example.

The conductive loop 26 may be positioned within the cover portion 22 and may consequently not be visible to a user of the electronic device 10. In other embodiments, the conductive loop 26 may be at least partially positioned on the exterior surface of the electronic device 10 and may consequently, be at least partially visible to a user of the electronic device 10.

The coupling member 28 may comprise any conductive material and may comprise copper for example. Additionally, the coupling member 28 may have any suitable shape and may be loop shaped, rectangular or square and so on in one or more planes. In various embodiments, the coupling member 28 may be referred to as an antenna.

The coupling member 28 is connected to the radio circuitry 14 and is configured to receive signals from, and/or provide signals to the radio circuitry 14. The radio circuitry 14 is configured to operate in a first frequency band (EGSM 900 for example) and is consequently configured to provide signals to the coupling member 28 and/or receive signals from the coupling member 28 in the first frequency band. Matching circuitry (not illustrated in the FIG. 2) may be provided between the radio circuitry 14 and the coupling member 28 to impedance match the coupling member 28 to the radio circuitry 14 at the first frequency band.

In some embodiments, the radio circuitry 14 may include only a single feed point and the coupling member 28 is connected to the single feed. In these embodiments, the radio circuitry 14 may be operable in a plurality of different operational frequency bands and protocols and the apparatus 12 may include suitable matching circuitry that enables the coupling member 28 to resonate (and hence be operable) in the plurality of different operational frequency bands and protocols.

The coupling member 28 is configured to electromagnetically couple with at least the conductive loop 26 and/or the conductive cover part 24. For example, the coupling member 28 may be positioned and arranged relative to the conductive loop 26 so that they may electromagnetically couple. The conductive cover part 24 and the conductive loop 26 have a first electrical length that is configured to provide a resonant mode in the conductive cover part 24 and the conductive loop 26 in the first frequency band.

In operation, the coupling member 28 transmits and/or receives electromagnetic signals in the first frequency band. The coupling member 28 electromagnetically couples with at least the conductive loop 26 and/or the conductive cover part 24. Where the coupling member 28 transmits or receives an electromagnetic signal, the resonant mode (having the first electrical length) in the conductive loop 26 and the conductive cover part 24 is excited. Consequently, the conductive cover part 24 and the conductive loop 26 form part of the resonant structure of the apparatus 12 and are operable in the first frequency band.

Various embodiments provide an advantage in that the electrical length (and hence resonant frequency band) of the combination of the conductive cover part 24 and the conductive loop 26 may be tuned to a desired frequency band by adjusting the dimensions of the conductive loop 26 while leaving the shape and dimensions of the conductive cover part 24 unaltered. This may be particularly advantageous where the conductive cover part 24 is an aesthetic design feature of the electronic device and is visible to a user of the electronic device 10.

Various embodiments also provide an advantage in that other electronic components of the electronic device 10 may be placed in the aperture 36 defined by the conductive loop 26. Additionally, where the conductive cover part 24 is a loop or other shape that defines an aperture, other electronic components of the electronic device 10 (for example, a loudspeaker) may be placed in the aperture defined by the conductive cover part 24. This may advantageously enable additional electronic components to be placed within the electronic device 10 and/or enable the size of the electronic device 10 to be reduced.

FIG. 3 illustrates a perspective view of another apparatus 121 according to various embodiments of the invention, and a Cartesian coordinate axis 38. The apparatus 121 illustrated in FIG. 3 is similar to the apparatus 12 illustrated in FIG. 2 and where the features are similar, the reference numerals are the same.

The apparatus 121 includes a conductive cover part 24, a first conductive loop 26, a second member 40, a first coupling member 28, and a second coupling member 42. The Cartesian coordinate axis 38 includes an X axis 44, a Y axis 46 and a Z axis 48 which are orthogonal to one another.

The conductive cover part 24 may extend around one or more side surfaces of the electronic device 10. In this embodiment, the conductive cover part 24 is a continuous loop which extends around each of the side surfaces of the electronic device 10 and consequently defines the perimeter of the electronic device 10 (as illustrated in FIG. 4). The conductive cover part 24 is 'continuous' along its peripheral length in that it does not include any cuts or splits through the conductive material that forms the conductive cover part 24. In various embodiments, the term 'continuous' may include cuts and apertures in the conductive material that do not extend all the way through the conductive material. Additionally, in various embodiments the term 'continuous' may mean that the conductive cover part 24 forms an unbroken electrical path.

Consequently, the conductive cover part 24 forms a continuous band around the electronic device 10. The loop shape of the conductive cover part 24 lies in a plane parallel to the X-Y plane and has a depth in the Z axis 48. In this embodiment, the conductive cover part 24 is galvanically coupled to the ground member 18. In other embodiments, the conductive cover part 24 may not be galvanically connected to the ground member 18 and may consequently be electrically isolated from the ground member 18. The conductive cover part 24 may be electromagnetically coupled to the ground member 18 or may couple galvanically to the ground member 18 via reactive components.

The first conductive loop 26 is connected to the bottom end of the conductive cover part 24 at the first end 30 and extends in the +Y direction until a position (a). At position (a), the first conductive loop 26 forms a right angled bend and extends in the −X direction until a position (b). At position (b), the first conductive loop 26 forms a right angled bend and extends in the +Y direction until position (c). At position (c), the first conductive loop 26 forms a right angled bend and extends in the +X direction until position (d). At position (d), the first conductive loop 26 forms a right angled bend and extends in the −Y direction until position (e). At position (e), the first conductive loop 26 forms a right angled bend and extends in the −X direction until position (f). At position (f), the first conductive loop 26 forms a right angled bend and extends in the −Y direction until the second end 32 where the first conductive loop 26 is connected to the conductive cover part 24.

The conductive cover part 24 and the first conductive loop 26 have a first electrical length that is configured to provide a first resonant mode in the conductive cover part 24 and the first conductive loop 26 in a first frequency band. The first electrical length is also configured to provide a second resonant mode in the conductive cover part 24 and the first conductive loop 26 in a third frequency band.

The conductive member 40 is a second conductive loop in this example. The second conductive loop 40 is positioned within the aperture 36 defined by the first conductive loop 26 and is electrically connected in parallel with the first conductive loop 26. The second conductive loop 40 may be integral with, or separate to the first conductive loop 26. The second conductive loop 40 is connected at a position (g) to the first conductive loop 26 between positions (a) and (b), and extends in the +Y direction until position (h). At position (h), the second conductive loop 40 forms a right angled bend and extends in the +X direction until position (i). At position (i), the second conductive loop 40 forms a right angled bend and extends in the −Y direction until position (j) where the second conductive loop 40 is connected to the first conductive loop 26.

The first coupling member 28 is connected to a first feed point 52 that is provided on the bottom left corner of the printed wiring board 18. The first feed point 52 is connected to the radio circuitry 14. The first coupling member 28 is loop shaped and extends from the feed point 52 in the −Y direction, forms a right angled bend and extends in the −X direction, then forms another right angled bend and extends in the +Y direction to a ground point on the ground member 18. The first coupling member 28 is consequently positioned in proximity to the conductive cover part 24, the first conductive loop 26 and the second conductive loop 40 and may be configured to electromagnetically couple with them.

The first coupling member 28 is configured to resonate in a second frequency band and to electromagnetically couple with at least the conductive cover part 24 and the first conductive loop 26. In various embodiments, the first coupling member 28 may be referred to as an inductive feed member. The first coupling member 28 is configured to provide a signal to, and/or, receive a signal from the radio circuitry 14 having a frequency band that at least partially overlaps with the first and second frequency bands. Consequently, the first coupling member 28 is configured to electromagnetically excite the first resonant mode in the first conductive loop 26 and the conductive cover part 24.

The second coupling member 42 is connected to a second feed point 54 that is provided on the bottom right corner of the printed wiring board 18. The second feed point 54 is connected to the radio circuitry 14. The second coupling member 42 is loop shaped and extends from the second feed point 54 in the −Y direction, forms a right angled bend and extends in the +X direction, then forms another right angled bend and extends in the +Y direction to a ground point on the ground member 18. The second coupling member 42 is consequently positioned in proximity to the conductive cover part 24, the first conductive loop 26 and the second conductive loop 40 and may electromagnetically couple with them.

The second coupling member 42 is configured to resonate in a fourth frequency band and to electromagnetically couple with at least the conductive cover part 24 and the first conductive loop 26. In various embodiments, the second coupling member 42 may be referred to as an inductive feed member. The second coupling member 42 is configured to provide a signal to, and/or, receive a signal from the radio circuitry 14 having a frequency band that at least partially overlaps with the third and fourth frequency bands. Consequently, the second coupling member 42 is configured to electromagnetically excite the second resonant mode in the first conductive loop 26 and conductive cover part 24.

It should be appreciated that the first and second coupling members 28, 42 may have any suitable shapes and dimensions, and portions of the coupling members may be formed in one or more planes. In the embodiment of FIG. 3, the first and second coupling members 28, 42 have the same shape and dimensions and are connected to matching circuits with the same topology but having different reactance values. In other embodiments, the first and second coupling members 28, 42 may have different shapes and dimensions and may have different matching circuit topologies. Furthermore, in other embodiments the first and second coupling members 28, 42 may have physical lengths which are resonant in the desired resonant frequency bands and may consequently not require a connection to matching circuitry.

Figure 5A:
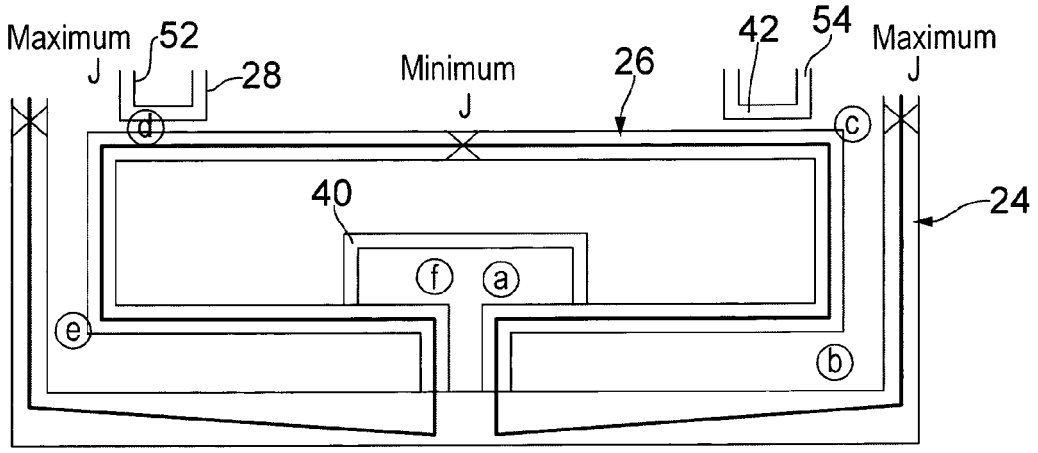
FIGS. 5A and 5B illustrates a schematic diagram of current density for the apparatus illustrated FIGS. 3 and 4.

FIG. 5A illustrates a schematic diagram of current distribution (represented by the thick line) for the first resonant mode. In this embodiment, the first resonant mode is a half wavelength mode having maximum current densities in the conductive cover part 24 adjacent the first and second coupling members 28, 42 and a minimum current density in the first conductive loop 26 halfway between positions (c) and (d).

Figure 5B:
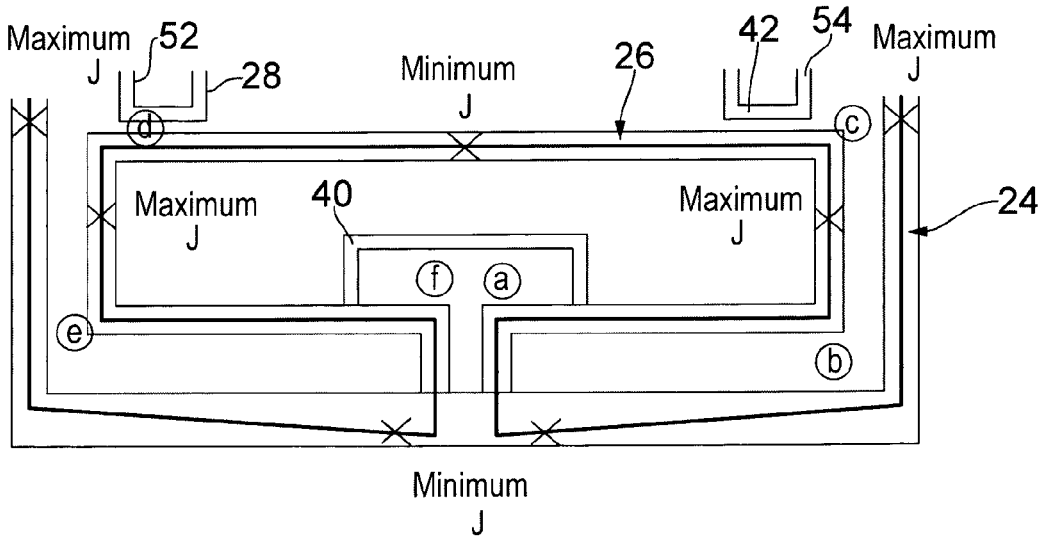

FIG. 5B illustrates a schematic diagram of current distribution (represented by the thick line) for the second resonant mode. In this embodiment, the second resonant mode is a one and a half wavelength mode. The second resonant mode has maximum current densities in the conductive cover part 24 adjacent the first and second coupling members 28, 42, and also in the first conductive loop 26 half way between positions (b) and (c) and halfway between positions (d) and (e). The second resonant mode has minimum current densities at the ends of the first conductive loop 26 and also in the first conductive loop 26 halfway between positions (c) and (d).

The second conductive loop 40 is positioned in the apparatus 121 where the current density is at a minimum for the second resonant mode and hence where the electric field strength is at a maximum. Consequently, the second conductive loop 40 capacitively loads the first conductive loop 26 and is thus configured to down tune (that is, lower in frequency) at least the second resonant mode of the first conductive loop 26 and the conductive cover part 24. For example, if the apparatus 121 does not include the second conductive loop 40, the second resonant mode may be centered at 2.3 GHz, whereas where the apparatus 121 includes the second conductive loop 40, the second resonant mode is centered at 1.9 GHz.

It should be appreciated that down tuning of the one and a half wavelength mode may also be achieved by inductive loading of the first conductive loop 26 at positions where the current density in the first conductive loop 26 is at a maximum.

It should be appreciated that the conductive member 40 may not be loop shaped in other embodiments. The conductive member 40 may be any member that provides inductive or capacitive loading and may have any suitable shape and dimensions that result in the tuning of one or more resonant modes of the apparatus 121 to a desired frequency band. The conductive member 40 may be an open end member.

The apparatus 121 may advantageously enable the electronic device 10 to be operable in multiple operational frequency bands. Since the second conductive loop 40 is positioned within the aperture 36 defined by the first conductive loop 26, the apparatus 121 may be relatively compact and may enable the electronic device 10 to be relatively small in size. Additionally, since the first and second conductive loops 26, 40 are positioned within the cover 22, they may be adjusted in dimensions to tune the first, second, third and fourth frequency bands without changing the exterior appearance of the electronic device 10.

Furthermore, since the conductive cover part 24 is a continuous conductive loop and does not include any split lines or cuts, the performance and/or efficiency of the apparatus 121 may be less affected by a user placing his hand on the conductive cover part 24 and providing a short circuit across the split line.

Additionally, it should be appreciated that for both the first and second resonant modes, the minimum current densities are advantageously located at positions where a user is unlikely or unable to touch while operating the electronic device. In particular, the minimum current densities are located inside the electronic device for both resonant modes and also at the bottom of the device for the second resonant mode. Even if a user does touch the conductive cover part 24 at positions (a) and (f), the half wavelength mode and one and a half wavelength mode still exist. Consequently, the performance and/or efficiency of the apparatus 121 may be less affected by a user holding or operating the device.

FIG. 6 illustrates a graph of frequency versus return loss for the apparatus 121. The graph includes a horizontal axis 56 that represents frequency (GHz), a vertical axis 58 that represents return loss (in dB) and a trace 60 that represents how the return loss of the apparatus 121 varies over frequency.

At 0 GHz, the return loss of the apparatus 121 is approximately equal to 0 dB. The trace 60 then has an increasingly negative gradient and reaches a first minima 62 of −11 dB at 0.9 GHz. The trace 60 then has a decreasingly positive gradient until a maxima of −7 dB at 0.95 GHz. The trace 60 then has an increasingly negative gradient and reaches a second minima 64 of −9 dB at 0.98 GHz. The trace 60 then has a decreasingly positive gradient and is at 0 dB between 1.1 GHz and 1.65 GHz. The trace 60 then has an increasingly negative gradient and reaches a third minima 66 of −29 dB at 1.9 GHz. The trace 60 then has a decreasingly positive gradient until a maxima of −21 dB at 1.95 GHz. The trace 60 then has an increasingly negative gradient and reaches a fourth minima 68 of less than −30 dB at 2.0 GHz. The trace 60 then has a decreasingly positive gradient and reaches 0 dB at 2.4 GHz.

The first minima 62 corresponds to the centre frequency of the first frequency band described above. The second minima 64 corresponds to the centre frequency of the second frequency band described above. The third minima 66 corresponds to the centre frequency of the third frequency band described above. The fourth minima 68 corresponds to the centre frequency of the fourth frequency band described above.

The trace 60 is below −6 dB between point 70 having a frequency of 0.88 GHz and point 72 having a frequency of 0.99 GHz. The trace 60 is also below −6 dB between point 74 having a frequency of 1.83 GHz and point 76 having a frequency of 2.09 GHz. Consequently, the apparatus 121 may be operable in any operational frequency band (such as any of those described above) within the frequency bands of 0.88 GHz to 0.99 GHz, and 1.83 GHz to 2.09 GHz. It should be appreciated that the apparatus 121 illustrated in FIG. 3 may be tuned differently and may be operable (for example) in any frequency band within the frequency bands 824 MHz to 960 MHz and 1710 MHz to 2170 MHz.

Figure 7:
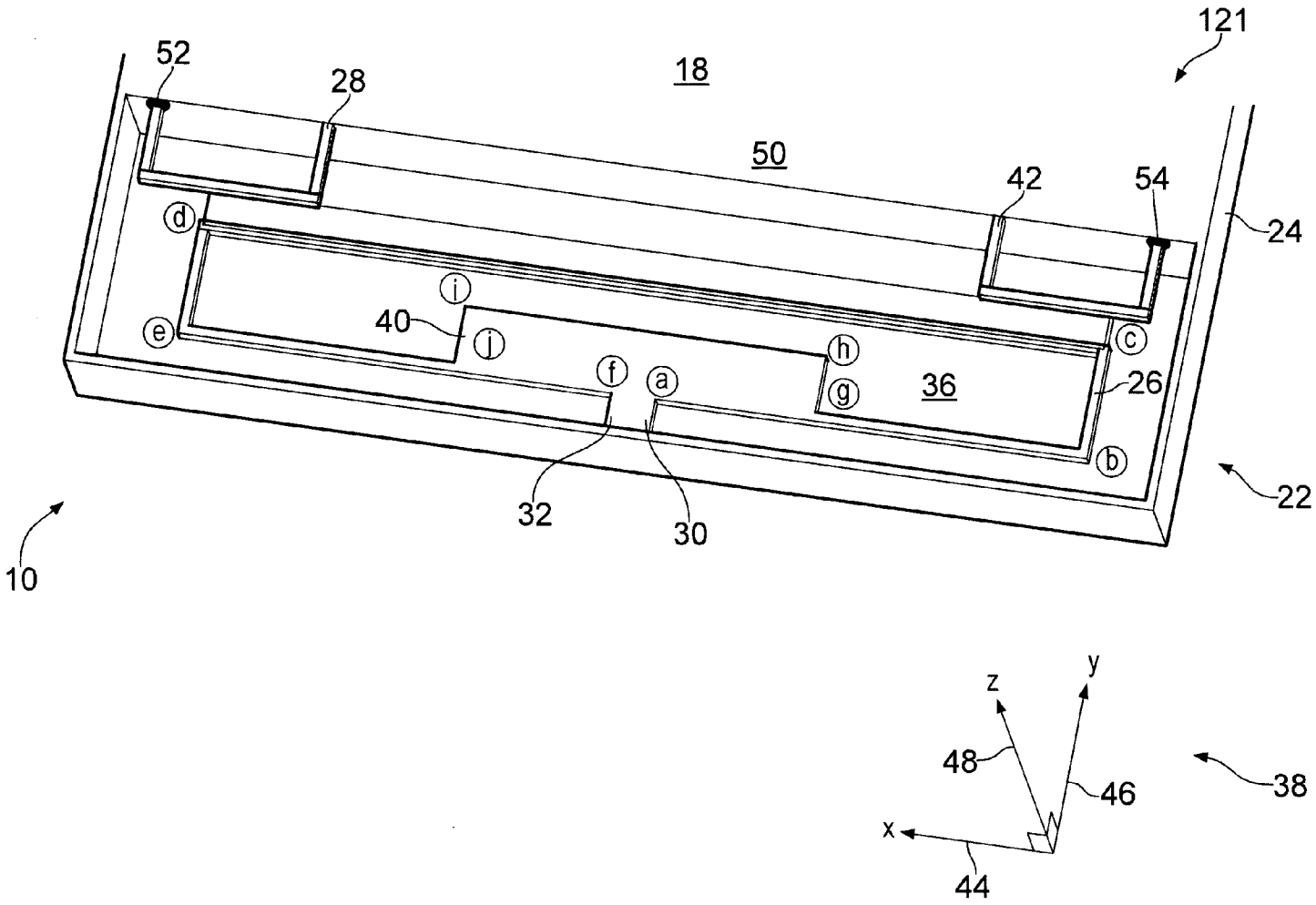
FIG. 7 illustrates a perspective view of a further apparatus according to various embodiments of the invention.

FIG. 7 illustrates a perspective view of an apparatus 121 according to various embodiments of the present invention. The apparatus illustrated in FIG. 7 is similar to the apparatus illustrated in FIG. 3 and where the features are similar, the same reference numerals are used.

The apparatus illustrated in FIG. 7 differs from the apparatus illustrated in FIG. 3 in that the conductive member 40 is a patch of conductive material forming a rectangular shape between positions (g), (h), (i) and (j).

Figure 8:
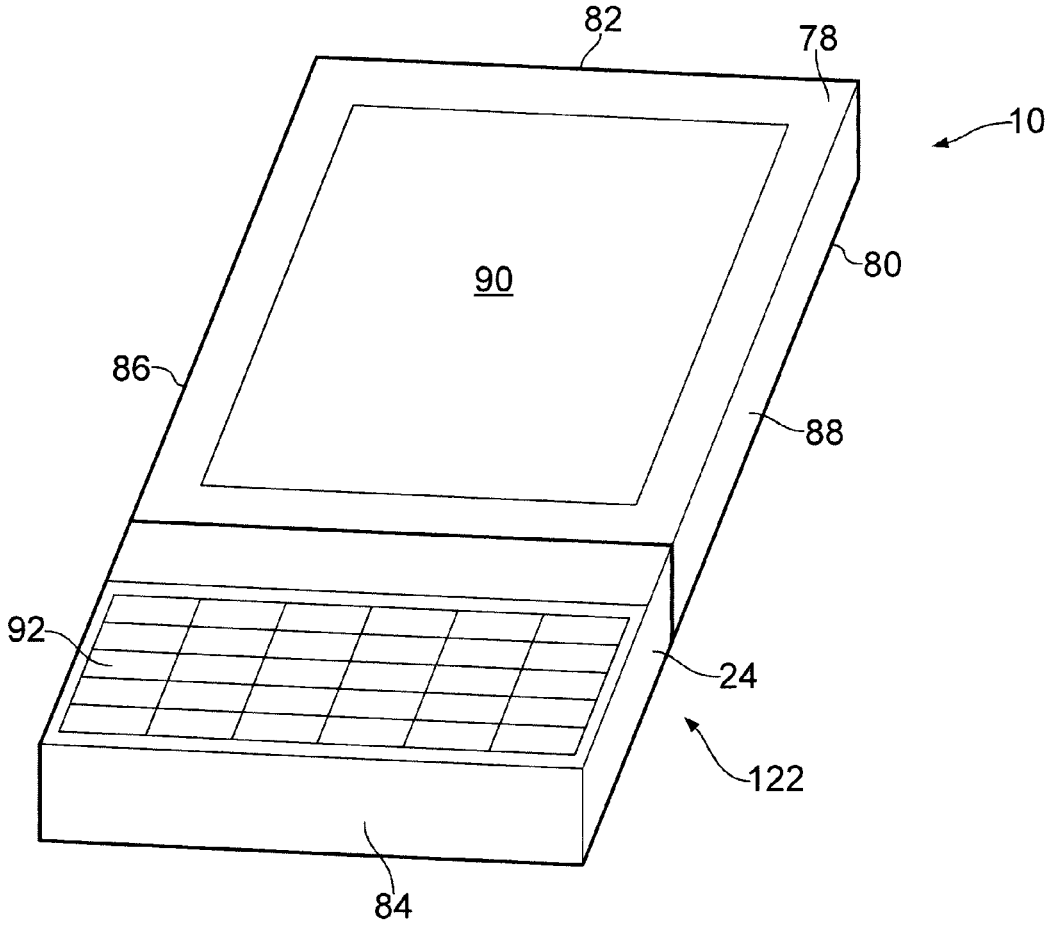
FIG. 8 illustrates a perspective view of an electronic device including a further apparatus according to various embodiments of the invention.

FIG. 8 illustrates a perspective view of an electronic device 10 including a further apparatus 122 according to various embodiments of the invention. The electronic device 10 includes a front surface 78, a rear surface 80, a top side surface 82, a bottom side surface 84, a left side surface 86 and a right side surface 88. The electronic device 10 includes a display 90 and a keypad 92 (for example, a QWERTY keypad) on the front surface 78.

The conductive cover part 24 is a continuous conductive loop that extends around the bottom side surface 84, up the right side surface 88 for approximately half of the length of the right side surface 88, across the front surface 78 between the display 90 and the keypad 92 and then down the left side surface 86.

It should be appreciated that the conductive cover part 24 may be provided on any one or more of the front surface 78, the rear surface 80, the top side surface 82, the bottom side surface 84, the left side surface 86 and the right side surface 88 and the embodiments illustrated in FIGS. 3, 4 and 7 are provided for exemplary purposes.

Figure 9:
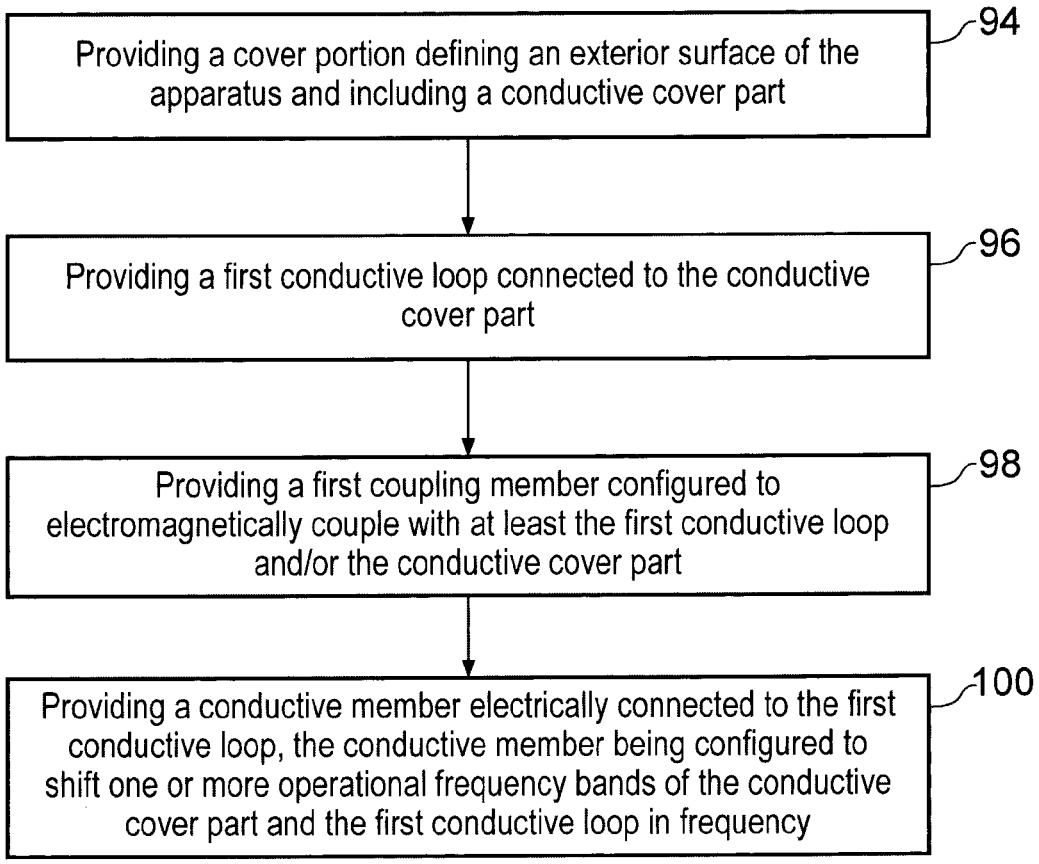
FIG. 9 illustrates a flow diagram of a method according to various embodiments of the invention.

FIG. 9 illustrates a flow diagram of a method for manufacturing an apparatus according to various embodiments of the invention. At block 94, the method includes providing a cover portion 22 defining an exterior surface of the apparatus 12, 121, 122 and including a conductive cover part 24.

At block 96, the method includes providing a first conductive loop 26. Where the first conductive loop 26 is integral with the conductive cover part 24, the first conductive loop 26 may be provided in block 94. Where the first conductive loop 26 is separate to the conductive cover part 24, the first conductive loop 26 may be joined (via welding for example) to the conductive cover part 24.

At block 98, the method includes providing a first coupling member 28 and configuring the first coupling member 28 to electromagnetically couple with at least the first conductive loop 26 and/or the conductive cover part 24. For example, the first coupling member 28 and the first conductive loop 26 and/or the conductive cover part 24 may be arranged in relative proximity to one another so that they may electromagnetically couple.

At block 100, the method may include providing a conductive member 40 electrically connected to the first conductive loop 26 and being configured to shift one or more operational frequency bands of the conductive cover part 24 and the first conductive loop 26 in frequency. Where the conductive member 40 is integral with the first conductive loop 26, the conductive member 40 is provided in block 96. Where the conductive member 40 is separate to the first conductive loop 26, the conductive member 40 may be joined (via welding for example) to the first conductive loop 26.

The blocks illustrated in the FIG. 9 may represent steps in a method and/or sections of code in a computer program. For example, a controller or processor may execute the computer program to control machinery to perform the method illustrated in FIG. 9. The illustration of a particular order to the blocks does not necessarily imply that there is a required or preferred order for the blocks and the order and arrangement of the block may be varied. Furthermore, it may be possible for some blocks to be omitted.

Although embodiments of the present invention have been described in the preceding paragraphs with reference to various examples, it should be appreciated that modifications to the examples given can be made without departing from the scope of the invention as claimed. For example, in the above embodiments the various apparatus have been described having right angled turns. It should be appreciated that the apparatus may have turns that are more or less than ninety degrees and the turns may be curved.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a cover portion including a conductive cover part;

a first conductive loop connected to the conductive cover part; and a first coupling member, connectable to radio circuitry and configured to electromagnetically couple with at least one of the first conductive loop and the conductive cover part, wherein at least the conductive cover part and the first conductive loop have a first electrical length and are configured to operate in a first frequency band, wherein the first conductive loop is galvanically connected to the conductive cover part at first and second ends of the first conductive loop, and wherein the conductive cover part forms a continuous conductive loop which provides at least part of an exterior surface of the apparatus.

2. An apparatus as claimed in claim 1, wherein the continuous conductive loop extends around at least one side surface of the apparatus.

3. An apparatus as claimed in claim 1, wherein the continuous conductive loop extends around a perimeter of the apparatus.

4. An apparatus as claimed in claim 1, wherein the first conductive loop is positioned within the cover portion.

5. An apparatus as claimed in claim 1, further comprising a conductive member electrically connected to the first conductive loop, the conductive member being configured to tune one or more resonant frequency bands of the conductive cover part and the first conductive loop in frequency.

6. An apparatus as claimed in claim 5, wherein the conductive member is positioned within the cover portion.

7. An apparatus as claimed in claim 5, wherein the conductive member is positioned within the first conductive loop.

8. An apparatus as claimed in claim 1, further comprising a second coupling member, connectable to radio circuitry and configured to electromagnetically couple with at least one of the first conductive loop and the conductive cover part.

9. A portable electronic device comprising an apparatus as claimed in claim 1.

10. A module comprising an apparatus as claimed in claim 1.

11. An apparatus as claimed in claim 1, further comprising an electronic component of the apparatus placed in an aperture defined by the conductive loop.

12. An apparatus as claimed in claim 11, wherein the electronic component includes a loudspeaker.

13. A method comprising:

providing a cover portion including a conductive cover part;

providing a first conductive loop connected to the conductive cover part; and providing a first coupling member, connectable to radio circuitry and configured to electromagnetically couple with at least one of the first conductive loop and the conductive cover part, wherein at least the conductive cover part and the first conductive loop have a first electrical length and are configured to operate in a first frequency band, wherein the first conductive loop is galvanically connected to the conductive cover part at first and second ends of the first conductive loop, and wherein the conductive cover part forms a continuous conductive loop which provides at least part of an exterior surface of the apparatus.

14. A method as claimed in claim 13, wherein the continuous conductive loop extends around at least one side surface of the apparatus.

15. A method as claimed in claim 13, wherein the continuous conductive loop extends around a perimeter of the apparatus.

16. A method as claimed in claim 13, wherein the first conductive loop is positioned within the cover portion.

17. A method as claimed in claim 13, further comprising providing a conductive member electrically connected to the first conductive loop, the conductive member being configured to tune one or more resonant frequency bands of the conductive cover part and the first conductive loop in frequency.

18. A method as claimed in claim 17, wherein the conductive member is positioned within the cover portion.

19. A method as claimed in claim 17, wherein the conductive member is positioned within the first conductive loop.

20. A method as claimed in claim 13, further comprising providing a second coupling member, connectable to radio circuitry and configured to electromagnetically couple with at least one of the first conductive loop and the conductive cover part.

* * * * *